US005584219A

United States Patent [19]

Dunn et al.

[11] Patent Number: 5,584,219

[45] Date of Patent: Dec. 17, 1996

[54] RELEASE DEVICE FOR MULTI GLAZING AIR CUSHION

[76] Inventors: Kenneth R. Dunn; Carole A. Dunn, both of 12 The Turnways, Leeds, Great Britain, LS6 3DU

[21] Appl. No.: 256,774

[22] PCT Filed: Jan. 27, 1993

[86] PCT No.: PCT/GB93/00168

§ 371 Date: Dec. 20, 1994

§ 102(e) Date: Dec. 20, 1994

[87] PCT Pub. No.: WO93/15297

PCT Pub. Date: Aug. 5, 1993

[51] Int. Cl.[6] ..... B26F 1/24

[52] U.S. Cl. ..... 83/745; 83/660; 225/103

[58] Field of Search ..... 83/745, 140, 143, 83/30, 660; 222/83, 87; 225/103

[56] References Cited

U.S. PATENT DOCUMENTS 1,401,968 1/1922 Domer ..... 222/83

3,180,524 4/1965 Shepard et al. ..... 222/83

4,428,518 1/1984 Abel ..... 225/103

FOREIGN PATENT DOCUMENTS 0778158 3/1935 France ..... 222/83

*Primary Examiner*—Kenneth E. Peterson

*Assistant Examiner*—Sean A. Pryor

[57] ABSTRACT

A release device for an air cushion or thermal insulation barrier of a double or multi glazed glass unit comprises interfitting first and second members which are movable relative to one another, the first member having associated with it a pin or striker which is movable with the first member from an inoperative position to an operative position to crack or penetrate one or more glass panels of the unit, the device has one or more ventilation orifices to enable release of the sealed air cushion or thermal insulation barrier between the panes of a glazed unit. To limit the relative movement of the first and second members of the device there is within the device interfitting projections. The device, which may include one or more springs, may be mounted on a support structure for movement from an inoperative position to an operative position.

10 Claims, 4 Drawing Sheets

RELEASE DEVICE FOR MULTI GLAZING AIR CUSHION

This invention relates to a release device for a multi glaze air cushion or thermal insulation barrier.

In the field of double or multi glazed glass units for doors and windows, the space(s) between the panes of glass form(s) air cushion(s) or thermal insulation barrier(s), and it is these air cushions or barriers which makes the breakage of the glass extremely difficult and in many cases impossible. Whilst this is very useful and more than advantageous to prevent forced entry through a double or multi glazed unit, the very same air cushion or thermal insulation barrier constitutes a real hazard should it be necessary for a person to make a hurried exit—via the window—from a room fitted with a double or multi glazed unit. In such circumstances, for example in the case of fire, it is virtually impossible for the person to break the glass and leave via the window in the event that any other exits are unusable.

The type of hazard related above is lessened to some degree when the window has an opening sash of sufficient dimensions and suitably positioned to enable exit therethrough, but the possibility of a necessarily hurried exit is not precluded and it is unlikely that such a hurried exit would be possible through such a restricted opening.

In most instances, double or multi glazed windows are sealed directly into a frame without an opening sash, and even where an opening sash is provided, the dimensions of such a sash are likely to be too small to enable a hurried exit to take place, or there may be window accessories that decrease the actual opening dimensions available or that create protrusions or obstacles constituting a danger for a person to make a hurried exit.

The present invention seeks to provide means whereby the air cushion or thermal insulation barrier between the panes of glass of a double or multi glazed glass unit may be released so as to enable said panes of glass to be broken.

According to the present invention there is provided a release device for an air cushion or thermal insulation barrier of a double or multi glazed glass unit, said release device comprising interfitting first and second members which are movable relative to one another, said first member having associated therewith a pin or striker which is adapted to move with said first member relative to said second member from a first inoperative position to a second operative position so as to penetrate a glass panel of said unit, characterized in that said device includes means to enable release of an air cushion or thermal insulation barrier of said glazed unit, said means comprising one through-bore or aperture.

The pin or striker will preferably be carried by and project from a carrier plate which is secured to said first member so as to be movable with said first member upon movement thereof relative to said second member.

The second member will have a through-bore therein to enable passage of a leading end of the pin or striker therethrough upon movement of the first member relative to the second member.

Means will preferably be provided to effectively limit the relative movement of the first and second members The carrier plate will preferably incorporate at least one through-bore or aperture to enable release of the air cushion or thermal insulation barrier from the said glazed unit. More preferably, there will be two such through-bores or apertures.

The pin or striker may have a pointed leading end, or the said leading end may be flat, or the said leading end may have a concave or convex bevel The device may include one or more springs to return the pin or striker to its initial inoperative position.

The device may include a safety pull ring or pin to prevent inadvertent movement of said first member relative to said second member.

The carrier plate may be movable relative to the first and second members.

The device may be mounted for pivotal movement from an inoperative position to an operative position relative to a pane of glass to be penetrated.

In order that the invention may be more readily understood, embodiments thereof will now be described, by way of example, reference being made to the accompanying drawings, wherein.

Figure 1:
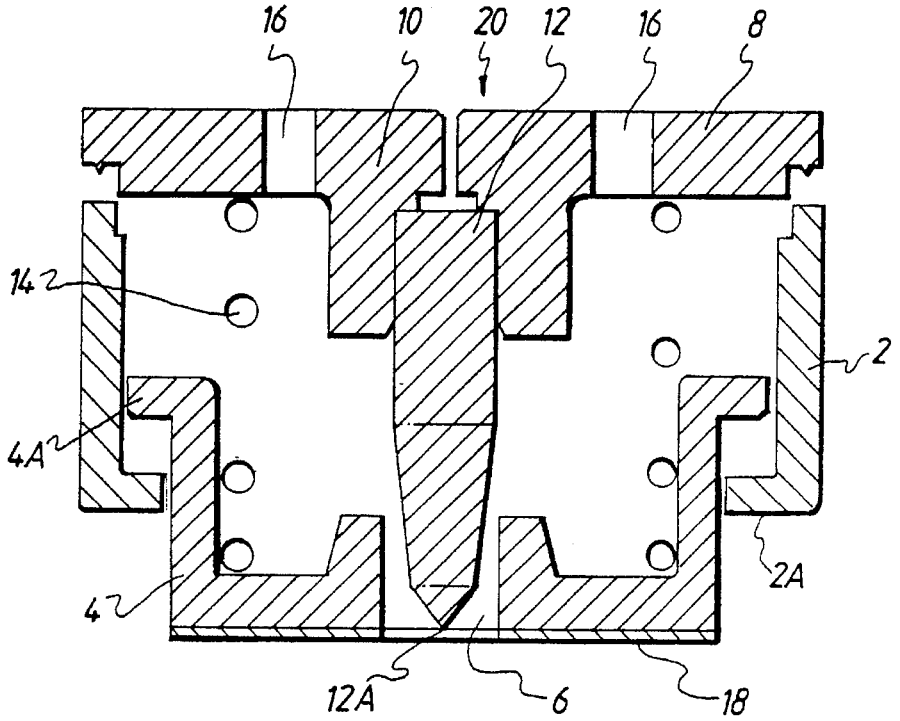
FIG. 1 is a longitudinal sectional elevation through a release device in accordance with the invention.
Figure 2:
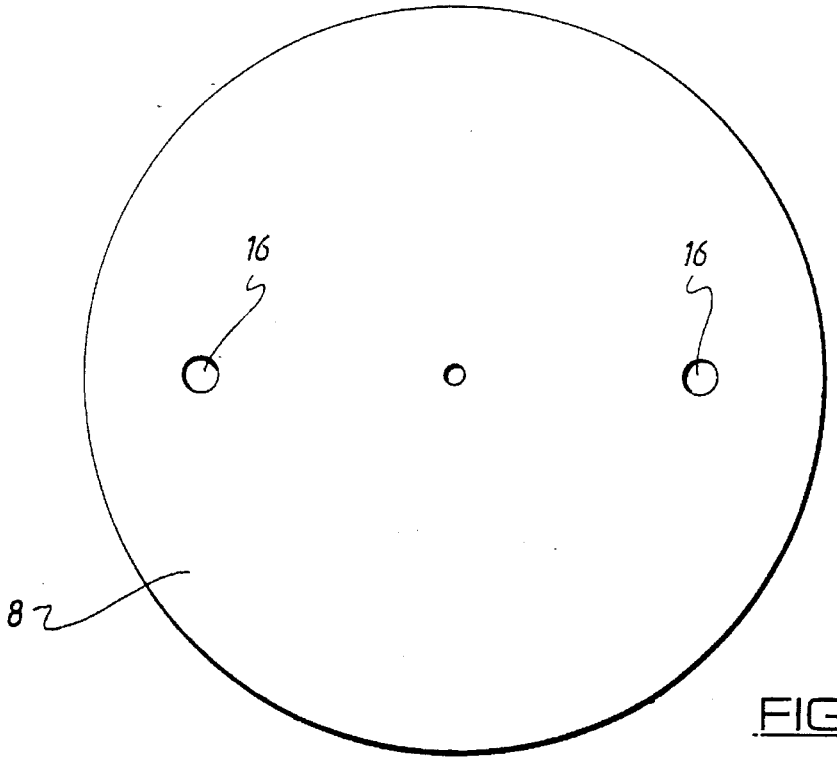
FIG. 2 is a plan view on FIG. 1.
Figure 7A:
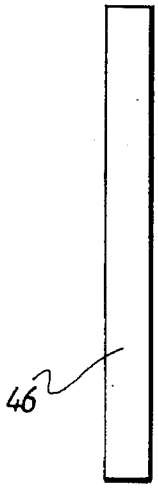
Figure 7B:
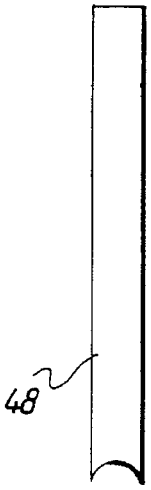
Figure 7C:
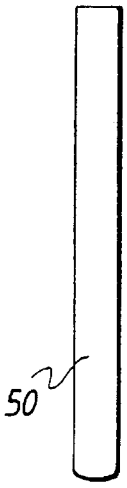
Figure 8:
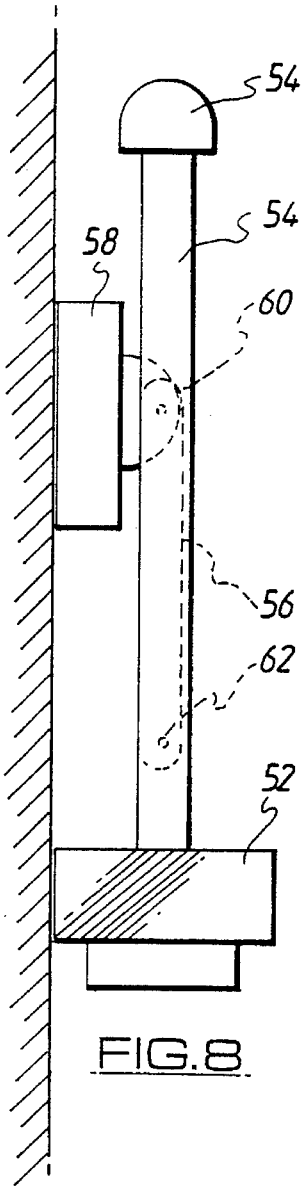
Figure 9:
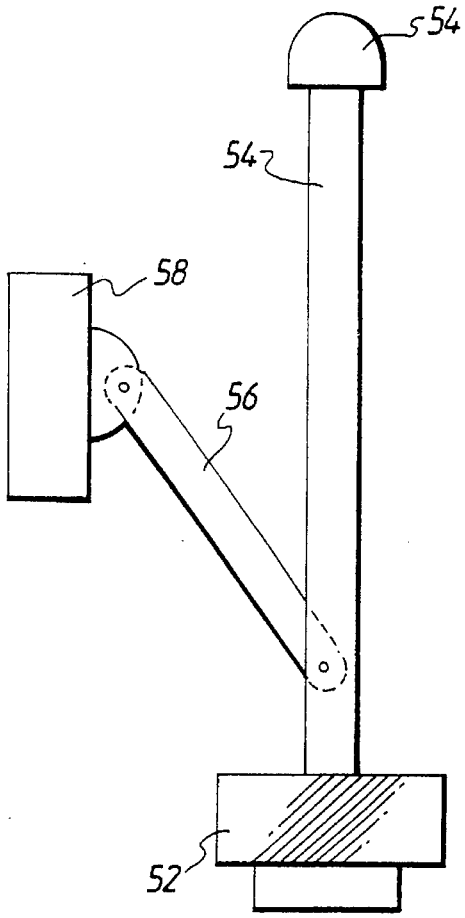

FIGS. 7A, 7B, and 7C show alternative forms of a pin or striker forming part of the release device;

FIG. 8 is an elevation showing the device of FIGS. 1 and 2 mounted on a pivotal arm and showing the device in a first, inoperative position;

FIG. 9 shows the device of FIG. 9 in a second, operative position; and

Figure 10:
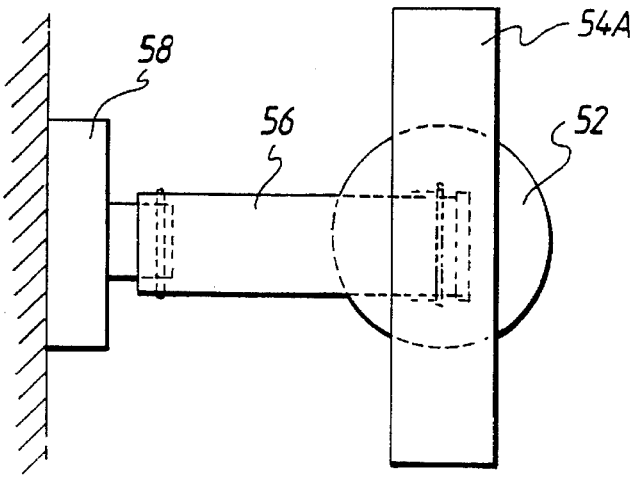

FIG. 10 is an end view on FIG. 9.

Referring to the drawings and firstly to FIGS. 1 and 2, a release device for an air cushion or thermal insulation barrier of a double or multi glazed glass unit comprises a first member 2 and a co-axial second member 4, the member 2 being provided with an inwardly directed flange 2A and the member 4 being provided with an outwardly directed flange 4A whereby the movement of the member 2 relative to the member 4 may be limited. The second member 4 is provided with a central through-bore or aperture 6.

Associated with the first member 2 is a carrier plate 8 which is securable to said first member, for example as by adhesive or by being an interference fit in said first member, and which has a centrally located boss 10 in which is secured a pin or striker 12 having a pointed end 12A. The carrier plate has venting through-bores or apertures 16.

Instead of the carrier plate being secured to the member 2, it may be formed integrally therewith.

A coil spring 14 is retained in position between the second member 4 and the carrier plate 8.

The members 2 and 4, and the carrier plate 8, are composed of plastics material, and the pin or striker 12 is formed of steel or other metal, but a pin or striker 12 of plastics material or indeed other suitable material is not precluded.

The second member 4 carries on its outer surface (lower in the drawing) a double-sided adhesive pad 18 by which the device may be attached and secured to a glass panel of a double or multi glazed glass unit, not shown. The adhesive pad 18 which, whilst holding the device in position, may be of composite materials which permit the device to be removed from the glass and, if required, re-fitted and/or re-positioned. The adhesive materials left on the glass following removal can be cleaned by the use of solvents or other cleaning means.

In use, the device is secured to an inner pane of glass of a double or multi glazed glass unit by means of the adhesive pad 18—the exterior of the pad will preferably carry a release paper (not shown) which is removed to enable the device to be secured in position—and in this position the pin or striker is clear of and not in contact with said pane of glass. In order to penetrate the pane of glass, the carrier plate 8 is struck by any suitable means in the direction of arrow 20 by, for example, a chair or any other convenient object—or even by hand—such that the carrier plate 8 and the first member 2 move in said direction relative to the second member 4. Because the pin or striker 12, through the intermediary of the carrier plate 8, is connected to the first member, the pin or striker 12 will also move in said direction such that the pin or striker comes into contact with and penetrates the pane of glass.

Simultaneously with the movement of the pin or striker 12, the coil spring 14 is compressed, and upon removal of the compressive force exerted by the striking means, the stored energy in the spring 14 will be dissipated so as to cause movement of the pin or striker 12 and the carrier plate 8 and the first member 2 so as to return them to their original positions. Thus the hole or perforation in the pane of glass caused by the penetration of the pin or striker 12 will be clear such that the air cushion or thermal insulation barrier between the panes of glass will be released, the cushion or barrier venting through the through-bores or apertures 16 in the carrier plate 8. With the air cushion or thermal insulation barrier released, it is then a relatively easy matter to break the pane of glass and other panes of glass of the glazing unit.

It will be appreciated that when the pin or striker 12 penetrates the pane of glass, the pane may well crack or fracture in which case the air cushion or thermal insulation barrier may vent through the said cracks or fractures—as well as or instead of venting through the through-bores or apertures 16, but as the breaking of glass in cases of emergency escape such as a fire may be imperative for the saving of life, it cannot be presumed that the glass or glasses will also crack or always crack, thus venting the double glazed unit or the multi glazed unit.

Figure 3:
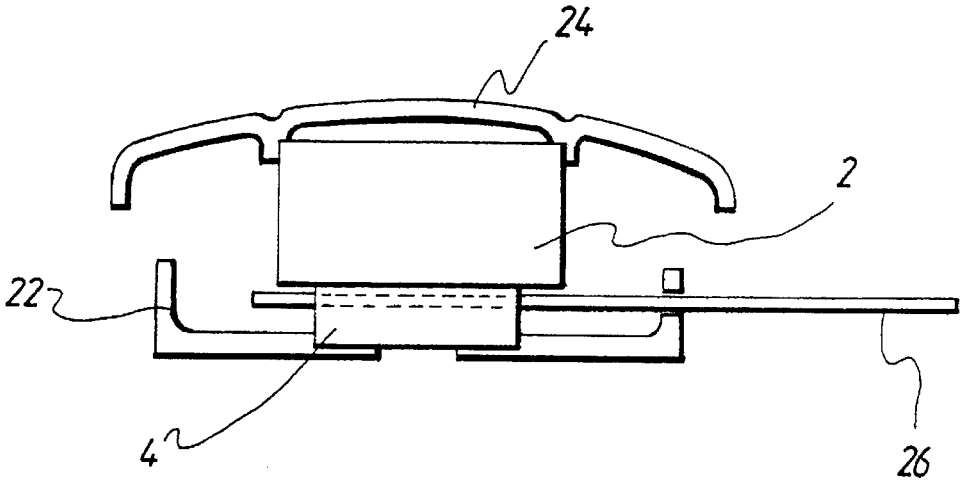
FIG. 3 is an elevation of the device of FIGS. 1 and 2 and showing a modification thereof.
Figure 4:
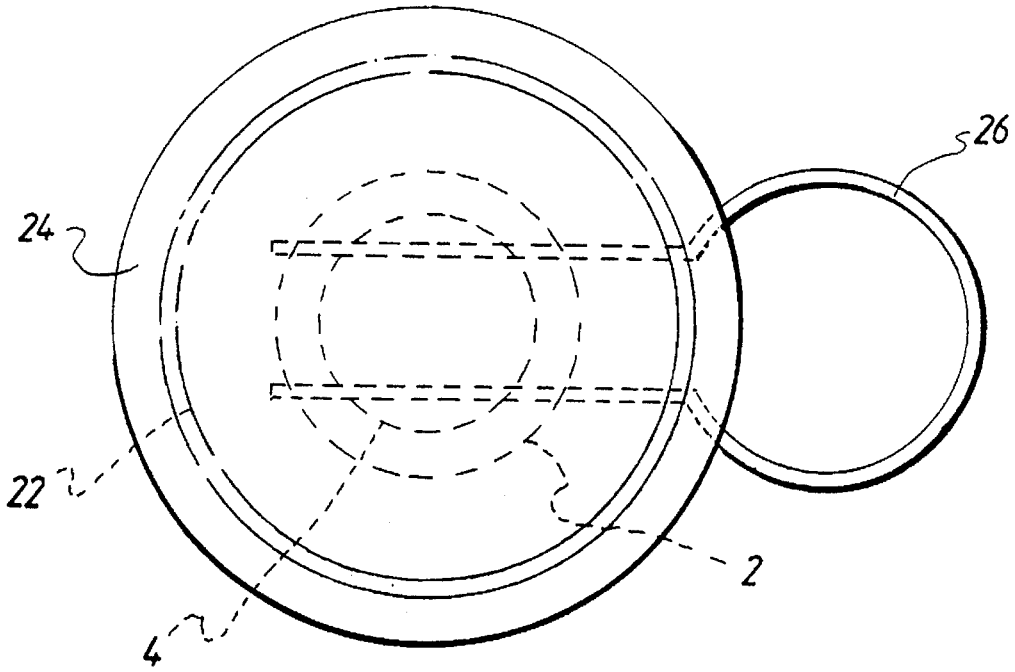
FIG. 4 is a plan view on FIG. 3.

The device shown in FIGS. 3 and 4 is the same in all material respects as that shown in and described with reference to FIGS. 1 and 2, but in this embodiment the second member 4 is carried by a larger base member 22 which is adhered to a pane of glass (not shown), the second member 4 being adhesively secured to said base member 22. In addition, the first member 2 carries a decorative mushroom head 24—which would preferably be removed before operation of the device. The device is provided with a safety pull ring 26 which embraces the second member 4 and which prevents inadvertent movement of the first member 2 relative to the second member 4. The safety pull ring 26 is withdrawn and removed to place the device in an operational position.

Figure 5:
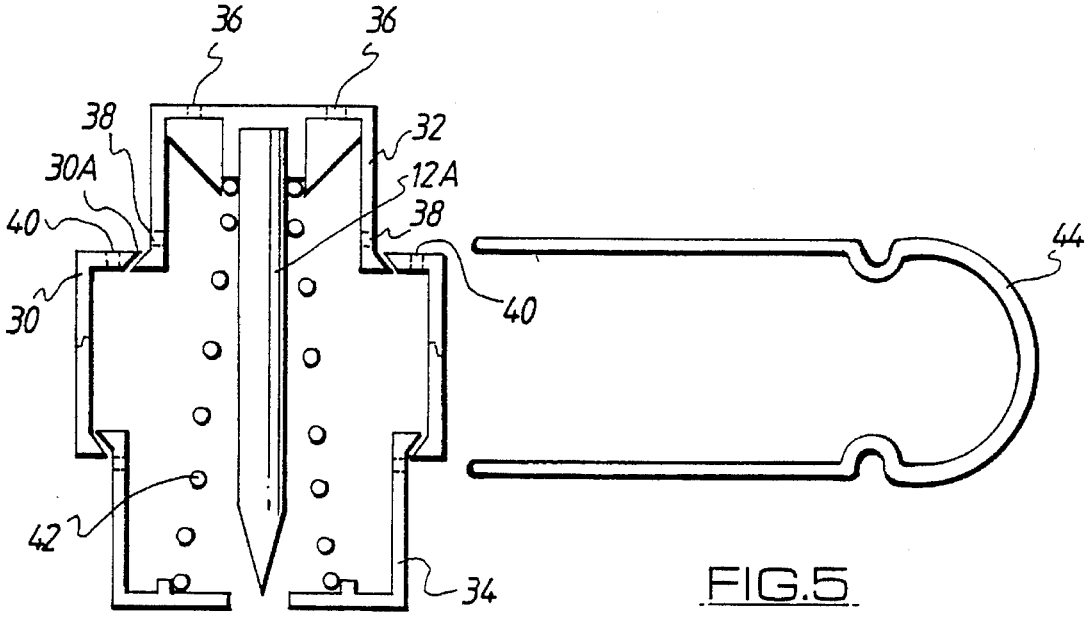
FIG. 5 is a longitudinal sectional elevation through an alternative form of a release device in accordance with the invention and showing the device in an inoperative position.
Figure 6:
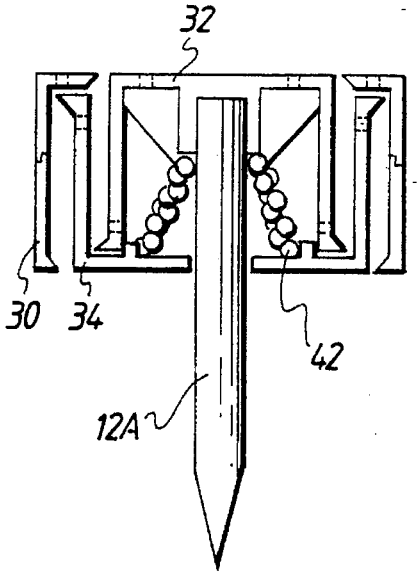
FIG. 6 shows the release device of FIG. 5 in an operative position.

Referring now to FIGS. 5 and 6, the device shown is modified to facilitate the use of a longer pin or striker 12A. In this embodiment, the first member 30 has an upper opening 30A through which a carrier member 32 may pass when these members move relative to the second member 34. The carrier member 32 in this embodiment is similar to the second member 34 and, whilst still carrying the pin or striker 12A, is movable relative to both the first member 30 and the second member 34. The carrier member includes venting through-bores or apertures 36 in its end surface and additional venting through-bores or apertures 38 in its walls. Additionally, venting through-bores or apertures 40 are provided in the first member 30.

A progressional compression spring 42 extends between the carrier member 32 and the second member 34, and a safety clip 44 to embrace the first member 30 is provided to prevent inadvertent relative movement of the members.

In use, and with the safety clip removed, an axial blow to the carrier member 32 will cause axial movement of the member 32 relative to the first member 30 and when the outboard ends of the members 32 and 30 are co-planar, the first member 30 will also move with the carrier member 32 relative to the stationery second member 34, until the device assumes the position shown in FIG. 6. Thus, in this position, the pin or striker 12A has been able to penetrate and pass through two or more panes of glass, resulting in venting of the air cushions or thermal insulation barriers, and in the case of toughened glass or glasses the removal of the now shattered glass(es) of the frame of the window is facilitated.

FIGS. 7A, 7B, and 7C show alternative forms of pins or strikers for use in the device of FIGS. 5 and 6. FIG. 7A illustrates a flat-ended pin or striker 46, FIG. 7B shows a concave bevelled pin or striker 48, whilst FIG. 7C shows a convex bevelled pin or striker 50. It will be appreciated that the pins or strikers 46, 48, and 50 may be used in the embodiment of FIGS. 1 and 2, although of course they may be of shorter length. The use of pins or strikers as shown in FIGS. 7A, 7B, and 7C, when striking the glass pane(s) will provide a different action to a pointed pin or striker, and would for instance create sound waves on wavelengths to cause fracture of the glass.

Turning to FIGS. 8 to 10, the device of FIGS. 1 and 2 is shown mounted on a wall and being movable from an inoperative position to an operative position. The device, indicated generally by reference numeral 52, is carried on an elongate arm 54 having a handle 54A, the arm 54, through the intermediary of a pivoting arm 56, being connected to a wall-mounted or frame-mounted bracket 58. The arm 56 is pivotally connected, by means of pins 60 and 62, to the bracket 58 and the elongate arm 54, and is movable about these pins from the inoperative position shown in FIG. 8 to the operative position shown in FIGS. 9 and 10.

The elongate arm 54 may be held in the FIG. 8 position by means of a clip on the wall fastening which lightly locks onto the arm. Alternatively, it may have a positive lock device which requires a positive action to place the device into an operative position. For example, a pin or clip passing through the arms 54 and 56 and through the wall bracket 58 may be provided.

To place the device into an operative position, the elongate arm 54 is moved away from the wall bracket 58 to the position shown in FIG. 9 and then rotated around the pivot of the wall bracket such that the device can be positioned adjacent the glass to be penetrated. This position is shown in FIG. 10. Thus any obstruction, for example the window frame, is clear from the action of the device. The device is then ready to have a force applied to the handle 54A so as to cause the pin or striker to act in the manner described earlier.

The device is suitable for single glazing, double glazed, or multi glazed windows, and will permit breach of standard and toughened glass and will also crack laminated glass or glasses, though further breaking and final dismembering may be extremely difficult.

Whilst the device is shown as a fixture to one side of a window, it will be appreciated that the device may be fitted to either side or adjacent to the top or bottom of the window.

The device may be a fixture as shown by being permanently affixed to the wall bracket or it can be made to be removable so as to permit use of the device on other windows.

With a device in accordance with the invention, the air cushion or thermal insulation barrier in a double glazed or multi glazed window or door unit is readily broken and released, such release in turn enabling the panel(s) of glass to be easily broken to provide an escape route in the case of an emergency. The device is simple to operate, and relatively inexpensive to produce.

It will be appreciated that the device may include more than one spring which may be of different ratings so as to possibly enhance the impact on the glass(es) and/or the withdrawal of the pin or striker.

In certain circumstances, the coil spring(s) or the compression spring(s) may be omitted, in which case the pin or striker would ideally be fluted or milled to allow venting of the air cushion or thermal insulation barrier.

Finally, whilst the devices disclosed show and describe a single pin or striker, devices having more than one pin or striker may be utilized if desired.

We claim:

1. A release device for an air cushion or thermal insulation barrier within at least one sealed section of a glazed glass unit of multiple panes, the release device comprising interfitting first and second members which are movable relative to one another, the first member having associated therewith a pin or striker which is adapted to move with the first member from a first inoperative position to a second operative position so as to penetrate one or more glass panels of a double or multi glazed unit, characterized in that the device includes a means to enable release of an air cushion or thermal insulation barrier of the glazed unit, the device further characterized in that the pin or striker is carried by and projects from a carrier plate which is secured to the first member so as to be movable with this first member upon movement relative to the second member and further characterized by the inclusion of two or more through bores or apertures in the carrier plate.

2. A release device as in claim 1 further characterized in that the second member has a through bore therein to enable passage of a leading end of the pin or striker therethrough upon movement of the first member relative to the second member.

3. A release device as in claim 1 or 2 further characterized in that the device includes at least one spring.

4. A release device as in claim 1 or 2 further characterized in that the first member and the second member includes flanges to limit the relative movement of the first and second members.

5. A release device in claim 1 or 2 further characterized in that the carrier plate includes more than two through bores or apertures in the carrier plate.

6. A release device as in claim 1 or 2 further characterized by the pin or striker having a pointed leading end.

7. A release device as in claim 1 or 2 further characterized in that the device includes a decorative mushroom head to enlarge the surface area of the first member and having where applicable an enlarged base to the second member.

8. A release device as in claim 1 further characterized in that the carrier plate is movable relative to the first and second members of the device.

9. The release device as in claim 1 or 2 may be mounted on an arm which is pivotal relative to a support structure to enable the device to be moved from an inoperative position to an operative position.

10. A release device as in claim 1 further characterized in that the device includes a safety pull ring or clip to prevent inadvertent movement between the first and second members.

* * * * *